US005624357A

United States Patent [19]

Englehart et al.

[11] Patent Number: 5,624,357

[45] Date of Patent: Apr. 29, 1997

[54] KAYAK SIMULATOR MACHINE

[75] Inventors: Susan L. Englehart; Richard J. Englehart, both of Middlefield, Ohio

[73] Assignee: Englehart Products Inc., Newbury, Ohio

[21] Appl. No.: 734,190

[22] Filed: Jul. 22, 1991

[51] Int. Cl.[6] ..... A63B 69/06

[52] U.S. Cl. ..... 482/72; 482/121; 482/122

[58] Field of Search ..... 482/99, 72, 102, 482/39, 116, 120, 70, 123, 52, 64, 62, 105, 124, 127; 272/72

[56] References Cited

U.S. PATENT DOCUMENTS

| | | | |
|---|---|---|---|
| 641,546 | 1/1900 | Kerns | 482/72 |
| 4,625,962 | 12/1986 | Street | 482/72 |
| 4,687,197 | 8/1987 | Larsson et al. | 272/72 |
| 4,717,145 | 1/1988 | Chininis | 272/72 |
| 4,728,102 | 3/1988 | Pauls . | |
| 4,781,374 | 11/1988 | Lederman | 482/99 |
| 4,844,456 | 7/1989 | Habing et al. | 482/99 |
| 4,880,224 | 11/1989 | Jonas | 482/72 |

FOREIGN PATENT DOCUMENTS

| | | | |
|---|---|---|---|
| 0218733 | 2/1985 | Germany | 272/72 |
| 1595544 | 9/1990 | U.S.S.R. | 272/72 |

OTHER PUBLICATIONS

"The Waterless Workout", *Canoe*, Aug. 1987, pp. 28–29.

*Primary Examiner*—Jerome Donnelly
*Attorney, Agent, or Firm*—Chattman, Gaines & Stern

[57] ABSTRACT

A kayak simulator machine is provided. The machine comprises a support assembly, a resistance-creating device coupled to the support assembly, a cord member coupled to the resistance-creating device, and a paddle-shaft coupled to the support assembly by the cord member. The paddle-shaft has opposite ends rotatably attached to the cord member whereby the paddle-shaft may be twisted relative to the cord member. The cord member is coupled to the resistance-creating device in such a manner that a pulling-resistance is imposed when the paddle-shaft is pulled, the pulling-resistance being greater than the pushing-resistance imposed when the paddle-shaft is pushed. The cord member is also coupled to the resistance-creating device in such a manner that the pulling-resistance is applied to the ends of the paddle-shaft. The paddle-shaft is coupled to the support assembly in such a manner that a center portion of the paddle-shaft may pivot in a three-dimensional pivot space.

6 Claims, 1 Drawing Sheet

KAYAK SIMULATOR MACHINE

FIELD OF THE INVENTION

This invention relates generally as indicated to a kayak simulator machine. More particularly, the present invention relates to a kayak simulating machine which allows a user to accurately simulate the kayaking stroke to thereby develop the correct technique used for kayaking as well as exercising the appropriate muscle groups.

BACKGROUND OF THE INVENTION

Watercraft sports which involve a person propelling a watercraft through a body of water, such as a river or lake, are popular outdoor activities. A watercraft sport which is of particular interest in the present application is kayaking. Although kayaks may be of many designs, a kayak will almost always include a hull which is pointed at both ends and which is covered with a full deck except for a centrally located cockpit.

The cockpit is specifically designed to accommodate a paddler in a certain sitting position. To this end, the cockpit usually includes a shallow seat and a foot brace. The shallow seat is attached to the bottom surface of the kayak in a location to the rear of the cockpit. The foot brace is attached to the bottom surface of the kayak at a location in front of the cockpit, and thus beneath the deck of the kayak. To begin a kayaking session the paddler sits on the shallow seat and separates and slightly bends his/her knees so that they create a V-shape form relative to the bottom surface of the kayak. The paddler's feet are placed on the foot brace and the top portion of his/her thighs are abutted against the underside of the deck in front of the cockpit.

In the actual kayaking process, the paddler will manipulate a single kayak paddle to propel the kayak through the water. A kayak paddle includes a paddle-shaft with two blades attached to opposite ends thereof. In this manner, one blade may be positioned on each side of the kayak. Although some rather sophisticated blade designs may be incorporated into a kayak paddle, the geometry of most, if not all, kayak blades will roughly approximate a planar surface.

While the kayaking stroke is quite complex, it may be initially viewed as alternately moving the blades of the paddle through the water. After a paddler is properly positioned in a kayak, the paddle-shaft is grasped in such a manner that the paddler's hands are in the same vertical plane as his/her respective shoulder. Consequently, the location of a paddler's hands on a paddle-shaft will depend on his/her physical make-up. More particularly, persons of different sizes will grasp a paddle-shaft in different locations and kayak paddles are therefore, usually designed to accommodate this "variable-grasp" phenomenon.

A kayaking stroke may be viewed as a combination of complimentary movements of each blade. These movements specifically include, for each blade, a air-push step, a water-entry step, a water-pull step and a water-exit step. Because the steps of the kayaking stroke are complimentary, not simultaneous, for the respective blades, one blade will be in a certain step while the other blade is a complimentary step of the kayaking stroke. More particularly, while one blade is in the air-push step, the other blade will be in the water-pull step thereby complimenting the pull with a push. Additionally, while one blade is in the water-entry step, the other blade will be in the water-exit step. Thus, the kayaking stroke may be viewed as four "combination" stages, namely a air-push/water-pull stage, a water-entry/water-exit stage, a water-pull/air-push stage, and a water-exit/water-entry stage.

Although the steps of the kayaking stroke are explained more fully below, it may be noted at this point that during the water-pull step the relevant blade will travel in water and that during the air-push stage the relevant blade will travel in air. When a blade is traveling through the water during the water-pull step, it is desirable to catch as much water resistance as possible to ensure efficient propelling. Conversely, because overcoming air resistance does little to propel the kayak, it is desirable to have as little air resistance as possible during the air-push step.

For these reasons the planar orientation of the blades will commonly be offset approximately 90° relative to each other. In this manner, one blade may travel through the air in a substantially horizontal plane to minimize air resistance, while the other blade may travel through the water in a substantially vertical plane to maximize propelling efficiency. However, as is explained in more detail below, this desirable design factor requires appropriate manipulations, or "paddle-shaft twisting", during the kayaking stroke to insure that the blade is properly positioned during the air-push and water-pull steps.

The details of the kayaking stroke are best explained by reviewing each of the four "combination stages" of the stroke. At what may be termed a starting point, the right blade is positioned to begin the air-push motion and the left blade is positioned to begin the water-pull motion. More particularly, the right hand, and the portion of the paddle-shaft gripped therein, are positioned at approximately ear level with the right elbow pointing down and slightly away from the body. The left arm is fully extended and positioned below the right arm and the left blade is positioned in the water, preferably as close to the side of the kayak as possible. Additionally, the right blade is positioned in a substantially horizontal plane to reduce air resistance during the subsequent air-push stage. This results in the left blade being positioned in a substantially vertical plane maximize efficiency during the subsequent water-pull stage.

To begin the air-push/water-pull stage, the right blade is pushed forward and the left blade is pulled rearward. The forward pushing of the right blade is accomplished by an inward and forward extension of the right arm and the rearward pulling of the left blade is accomplished by a retraction of the left arm. More specifically, the right arm is extended forward by rotation of the shoulders, torso and abdomen, and at the end of this air-push stroke, the right hand should be positioned over the kayak's axial centerline. One may appreciate that, because the right blade is traveling through the air, a minimum amount of energy is required to execute this forward pushing.

Regarding the rearward pulling of the left blade, this movement is accomplished by pulling with the lower arm in manner that the paddle-shaft remains perpendicular to the wrist and the lower forearm is parallel to the water surface. The paddle-shaft should remain fairly vertical throughout this water-pull step and the left blade should be kept as close to the kayak as possible to minimize any turning of the boat. If the water-pull stage is correctly performed, the majority of the "pulling" power will come from the twisting/untwisting of the paddler's torso.

The end of the air-push/water pull stage of the kayaking stroke marks the beginning of the water-entry/water-exit stage. In this stage, the right blade is implanted in the water and the left blade is removed from the water. However, slightly before this implantation and removal, the paddle-shaft is twisted so that the right blade is positioned in a substantially vertical plane and the left blade is positioned in substantially horizontal plane.

The water-entry of a kayak blade is critical for maximum power and efficiency because it places the blade in the vertical orientation necessary for the effective application of power. A properly executed water-entry gives the blade a "firm grip" on the water so that the kayak moves forward in relation to the blade, or in other words, moves the kayak towards the blade. Some commentators suggest that a paddler should visualize setting the blade in concrete so that the kayak, not the blade, moves through the water. In any event, at the completion of this water-entry step, the right blade is ready to begin the water-pull stage of the kayaking stroke.

The water-exit stage is performed by withdrawing the left blade from the water when the left hand becomes even with the paddler's hip. This withdrawal is accomplished by moving the left hand upward and continuing this upward movement until the left hand is positioned approximately at ear level with the left hand pointing down and slightly away from the body. It may be noted for future reference that this positioning places the paddler in a condition to begin a subsequent air-push stage.

Timing is especially crucial in the water-exit stage because if the blade exits the water too early, a paddler is essentially cheated of potential "pulling" power. Conversely, if the blade exits the water too late, the blade drags thereby frustrating the forward progress of the kayak. Additionally, a "late" water-exit will require a backwards pull on the paddle to get the blade out of the water. This backwards pull is a nonproductive use of energy and moreover, may cause the back of the kayak to sink slightly, thereby further impeding the forward travel of the kayak.

After completion of this water-entry/water-exit stage of the kayaking stroke, the paddler is positioned to begin the water-pull/air-push stage. More specifically, the right paddle is positioned to begin the water-pull step and the left paddle is positioned to begin the air-push step. Thus, these steps may be performed in the above-described manner.

One may appreciate that the kayaking stroke requires a pivoting of the center of the kayak-paddle to accomplish the complementary stages of the stroke. However, it is important to note that this pivoting does not occur about a fixed pivot point. Instead, the "pivot point" of the kayaking stroke travels in a three-dimensional path during the various stages of the stroke, and thus, may be more accurately termed a "pivot space." Additionally, the size, shape, and location of this pivot space will vary for different paddlers.

Due to the unique nature of the kayaking stroke, it requires a paddler to learn a certain technique of paddling which differs greatly from those used in other water craft sports, such as rowing and canoeing. Additionally, the particular muscle development required for enhanced or competitive kayaking is believed to be distinctive for this particular watercraft sport. More particularly, the kayaking stroke exercises the wrist flexors, wrist extensors, biceps, and triceps in a paddler's arms. Additionally, certain muscle groups in the paddler's torso are also exercised, such as the deltoids, pectoralis major, trapezius, latissimus dorsi, spinal rotators, rhomboids, rotator cuffs, and the abdominals. Still further, the kayaking stroke requires isometric resistance for the lower extremity of the paddler's body.

Consequently, for economic and time-constraint reasons, a paddler may wish to develop his/her kayaking skills without actually putting a kayak in the water. In the past, exercise machines have been developed to simulate certain outdoor activities such as bicycling, cross-country skiing, and perhaps most relevant in this discussion, rowing. However due to the uniqueness of the kayaking stroke, these machines are believed to be unsuitable for indoor kayak training. More specifically, these machines do not allow for simulation of "paddle-twisting" and sometimes do not permit variable hand positions. Additionally, to the extent that conventional machines allow for rotation of some sort of shaft, the rotation usually must occur around some fixed pivot point, rather than a three-dimensional pivot space. Still further, these machines usually do not compensate for the change in resistance in the air-push and water-pull stages of the kayaking stroke nor do they imitate the blade-specific resistance during the water-pull stage.

Applicants therefore believe that a need remains for a kayak simulator machine which accurately simulates the kayaking motion and thereby develops the correct kayaking technique as well as exercising the appropriate muscles.

SUMMARY OF THE INVENTION

The present invention provides a kayak simulator machine which accurately simulates the kayaking motion and thereby develops correct kayaking technique as well as exercising the appropriate muscles.

More particularly, the kayak simulator machine comprises a support assembly, a resistance-creating device coupled to the support assembly, a cord member coupled to the resistance-creating device, and a paddle-shaft coupled to support assembly by the cord member. The paddle-shaft has opposite ends rotatably attached to the cord member, whereby the paddle-shaft may be twisted relative to the cord member. The cord member is coupled to the resistance-creating device in such a manner that a pulling-resistance is imposed when the paddle-shaft is pulled, the pulling-resistance being greater than the pushing-resistance imposed when the paddle-shaft is pushed. The cord member is also coupled to the resistance-creating device in such a manner that the pulling-resistance is applied to the ends of the paddle-shaft. Additionally, the paddle-shaft is coupled to the support assembly in such a manner that a center portion of the paddle-shaft may pivot in a three-dimensional pivot space.

These and other features of the invention are fully described and particularly pointed out in the claims. The following descriptive annexed drawings set forth in detail one illustrative embodiment. However, this embodiment is indicative of but a few of the various ways in which the principles of the invention may be employed.

DETAILED DESCRIPTION

Figure 3:
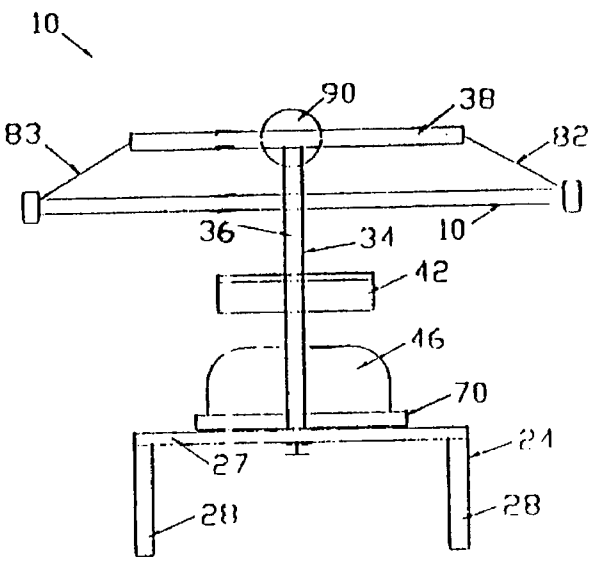
FIG. 3 is a front view of the kayak simulator machine.
Figure 1:
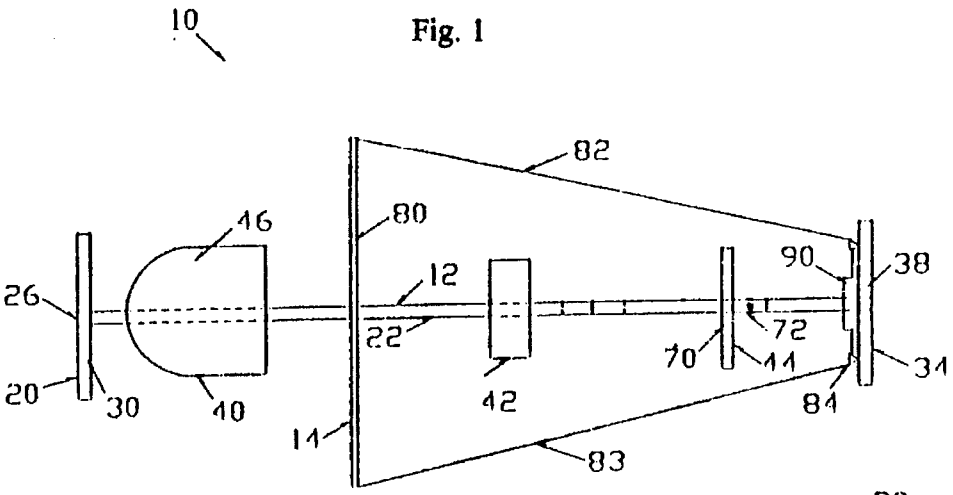
FIG. 1 is a top view of a kayak simulator machine according to the present invention.
Figure 2:
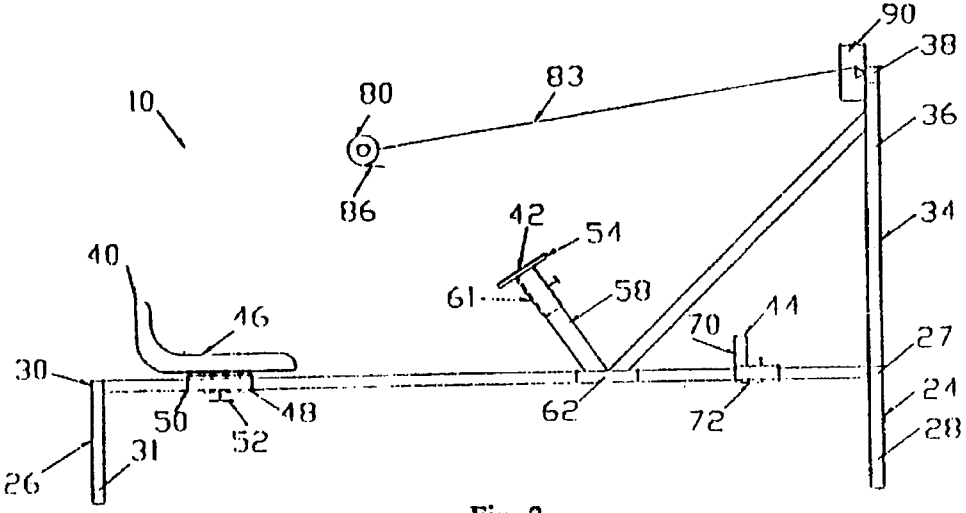
FIG. 2 is a side view of the kayak simulator machine.

Referring now to the drawings in detail, and initially to FIGS. 1–3, a kayak simulator machine according to the present invention is indicated generally at 10. The kayak simulator machine 10 includes a support assembly which is indicated generally at 12 and a paddle-shaft assembly which is indicated generally at 14. As is explained in more detail below, the support assembly 12 and the paddle-shaft assembly 14 coordinate during the operation of the kayak simulator machine 10 to accurately simulate the kayaking stroke.

In this manner, a correct kayaking stroke may be developed or refined by a user, while at the same time the appropriate muscles may be developed and exercised.

Addressing initially the support assembly 12, it includes a support frame which is indicated generally at 20 and which forms the structural skeleton of the kayak simulator machine 10. The support frame 20 includes a longitudinal support member 22 which, in the preferred embodiment, is approximately fifty-six inches in length. Two end support members, which are indicated generally at 24 and 26, are attached to opposite ends of the longitudinal support member 22. More particularly, the end support member 24 is attached to what may be termed the "front end" of the longitudinal support member 22 and the end support member 26 is attached to the opposite "back end" of the member 22. Consequently, component 24 may be referred to as the front end support member and component 26 may be referred to as the back end support member. It may be noted for future reference that a similar convention will be used for generally indicating the front and back ends of the kayak simulator machine 10.

The front end support member 24 includes a horizontal bar 27 and two vertical bars 28 projecting downwardly from opposite ends thereof, whereby the member is roughly in the shape of an inverted "U". The backend support member 26 includes analogous and essentially identical components, namely a horizontal bar 30 and two vertical bars 31. The horizontal bars 27 and 30 are attached, as by welding or any other suitable methods, to the front and back ends, respectively, of the longitudinal support member 22. In this manner, the distal ends of the vertical bars 28 and 31 may rest against a horizontal surface, such as a floor (not specifically shown), and the longitudinal support member 22 will be positioned at an elevated level.

The support assembly 12 further includes a top support member which is indicated generally at 34 and which is generally in the shape of a "T". The top support member 34 is comprised of a vertical bar 36 which is approximately twenty-four inches in height and a top horizontal bar 38 which is approximately twenty inches in length. The vertical bar 36 is attached to the support frame 20 in such a manner that it extends upwardly at the front end of the kayak simulator machine 10. In the illustrated embodiment, this attachment is accomplished by coupling the lower end of the vertical bar 36 to the upper surface of the front end support member 24. As is explained in more detail below, certain components of the paddle-shaft assembly 14 are mounted to the top horizontal bar 38.

The support assembly 12 further includes components which directly interface with a user of the kayak simulator machine 10. More specifically, the support assembly 12 includes an adjustable seat unit indicated generally at 40, a thigh brace unit indicated generally at 42, and a foot brace unit indicated generally at 44. The seat unit 40, the thigh brace unit 42 and the foot brace unit 44 are strategically coupled to the support frame 20 in such a manner that a user properly interfacing with these components will be situated in a kayak simulating position. The adjustable seat unit 40 is located towards the back end of the machine 10, the foot brace 44 is located towards the front end of the machine 10, and the thigh brace unit 44 is located therebetween.

The adjustable seat unit 40 includes a seat surface 46 which is shaped to accommodate a user in a sitting position and which is coupled to the support frame 20 by a linear-adjustment member indicated generally at 48. "Linear-adjustment member" in this context corresponds to any device which allows the seat surface 46 to be selectively moved, or adjusted, along the longitudinal length of the support frame 20. In the illustrated and preferred embodiment, the linear adjustment member 48 comprises a square tube 50 which is telescopically coupled to the longitudinal support member 22 whereby the adjustable seat unit 40 may be selectively moved therealong. A lock-screw 52 is provided to lock the adjustable seat unit 40 in the desired position.

The thigh brace unit 42 includes a thigh-abutting member 54 which is coupled to the support frame 20 and the top support member 34 by an angle-mounting member indicated generally at 56. The angle-mounting member 56 includes a first bar 58 and a second bar 60 which are joined together at an approximately, but not quite, 90° junction. The thigh-abutting member 54 is adjustably attached, via an adjustment mechanism 61, to the distal end of the first bar 58.

As is best seen in FIG. 2, the junction of the angle-mounting member 56 is fixedly secured to the support frame 20, or more particularly to the longitudinal support member 22, by a coupler 62. The first bar 58 extends upwardly, in an approximately 65° angle, from the longitudinal support member 22 and towards the back end of the kayaking simulating machine 10. Regarding the second bar 60, it extends upwardly from the longitudinal support member 22 and towards the front end of the machine 10. The opposite or distal end of the second bar 60 is attached to the vertical bar 36 of the top support member 34.

The foot brace unit 44 includes a horizontal foot platform 70 which is coupled to the support frame 20 by a linear-motion coupler 72. In the preferred and illustrated embodiment, this linear-motion coupler 72 is similar to the adjustment member 48 of the seat unit 40. As such, the foot brace unit 44 may be adjustably positioned along the relevant length of the longitudinal support member 22.

To begin a kayak simulating session, the machine 10 is adjusted so that a user nay be situated in a position simulating his/her kayaking position. More specifically, the user sits on the seat surface 46 and separates and slightly bends his/her knees so that they create a V-shape form relative to a horizontal line. The foot brace unit 44 is properly adjusted so that the user's feet may rest on the foot platform 70 as they would on a foot brace in an actual kayak. Additionally, the thigh brace unit 42 is adjusted so that the top portion of the user's thighs will be abutted against the thigh abutting member 54, this member performs the function of the underside of the deck in an actual kayak.

Turning now to the paddle-shaft assembly 14, it constitutes the actual moving or exercising components of the machine 10. The paddle-shaft assembly 14 specifically includes a paddle-shaft 80, a cord member which is comprised of push/pull cords 82 and 83, and a resistance-creating device which is indicated generally at 84. These components of the paddle-shaft assembly 14 coordinate with each other to allow an exercising motion simulating that of paddling a kayak.

More particularly, the paddle-shaft 80 is dimensioned and may be positioned by a user to simulate a dual-blade kayak paddle. For example, the paddle-shaft 80 is cylindrical in shape and preferably approximately fifty inches in length. Additionally, the paddle-shaft 80 is designed so that a user may place his/her hands anywhere along the length of the shaft as would be the case when gripping a kayak paddle in an actual kayaking situation.

Another feature of the paddle-shaft assembly 14 which allows a user of the machine 10 to accurately simulate a kayaking stroke, is the coupling of the free ends of the push/pull cords 82 and 83 to the ends of the paddle-shaft 80. This coupling is accomplished by rotational-freedom members 86 which, in the preferred embodiment, constitute conventional bearings. In this manner, the user of the machine 10 may rotate the paddle-shaft 80 to simulate "paddle-shaft twisting" of a kayak, a wrist action which is essential to compensate for the offset blades of an actual kayak paddle-shaft.

Additionally, the paddle-shaft 80 is coupled to the machine only through the push/pull cords 82 and 83 as is best seen in FIGS. 1 and 2. Consequently, the paddle-shaft 80 need not be pivoted about a fixed pivot point. Instead, the paddle-shaft 80 may be pivoted about a three-dimensional pivot space as would occur in a properly executed kayaking stroke. Moreover, the size, shape and location of this pivot space may be varied for different users of the kayaking simulating machine 10.

The resistance-creating device 84 is specifically designed to simulate the resistance experienced during a kayaking stroke. More particularly, the resistance-creating device 84 includes components which impose a pulling-resistance when an end of the paddle-shaft 80 is pulled and a pushing-resistance, or more accurately a lack thereof, when an end of the paddle-shaft 80 is pushed. The pulling-resistance is greater than the pushing-resistance (which is preferably essentially zero) to simulate the water-pull and air-push steps of the kayaking stroke, respectively. Additionally, the resistance-creating device 84 includes components which apply the pulling resistance to the ends of the paddle-shaft 80 to imitate the blade specific resistance encountered during the water-pull step of a kayaking stroke.

Figure 4:
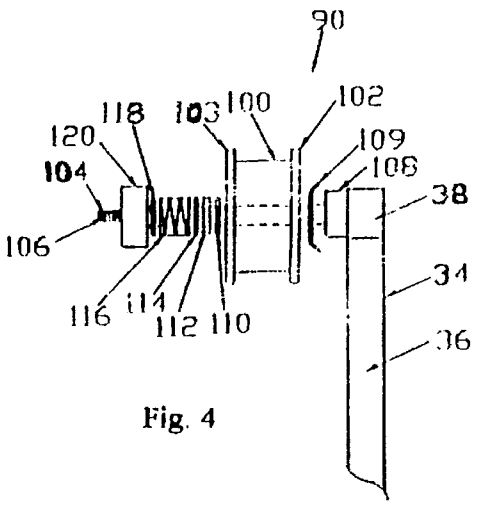
FIG. 4 is enlarged view of a certain component of the kayak simulator machine, namely a tension mechanism.

To accomplish these simulations, the resistance-creating device 84 includes a tension mechanism 90 which is illustrated in detail in FIG. 4. The tension mechanism 90 includes a winding drum 100 having metal plate or end flanges 102 and 103. One push/pull cord 82 is attached to the inner side of the drum 100 adjacent the end flange 102 and the other push/pull cord 83 is attached to the outer side of the drum 100 adjacent the end flange 103. One cord is wrapped around the drum three times in the clockwise direction and the other cord is wrapped around the drum three times in the counterclockwise direction. In this manner, while one cord 82/83 is winding, the other cord 83/82 will be unwinding.

The winding drum 100 is pivotally mounted to the horizontal bar 38 of the top support member 34 by a rod 104 which extends through a central opening in the drum (not specifically numbered) and which includes a threaded distal end 106. A bracket (or first member) 108 supports the winding drum (or second-member) 100 away from the top horizontal bar 38 and a friction-absorbing member 110, such as a leather, plastic or rubber strip, is mounted between the bracket 108 and the inside end flange 102.

On the opposite end of the winding drum 100, a first washer 110, a flat bearing 112, a second washer 114, a spring-member 116, and a third outside washer 118 are sequentially mounted on the rod 104, with the first washer 110 being positioned immediately adjacent the outer end flange 102. A resistant adjustment member 120, which in the illustrated embodiment is in the form of a hand knob, is threaded onto the rod 104 on its outer threaded distal end 106. Tightening the resistant adjustment member 120 applies pressure on the spring-member 116 thereby increasing the resistance created by the tension mechanism 90. Conversely, loosening this member releases pressure on the spring member 116 thereby decreasing the resistance. In this manner, a user may set the machine to the desired resistance.

When a user is simulating the water-pull/air-push stage of the kayaking stroke, his/her right hand will be pulling the right end of the paddle-shaft 80 thereby encouraging the cord 82 to unwind from the winding drum 100 as winding drum 100 rotates in a clockwise (one) direction. During this pulling, the user must overcome a certain pulling-resistance created by the tension mechanism 90 just as a paddle must overcome water-resistance during the water-pull step of a kayaking stroke. Simultaneously, the left hand will be pushing the left end of the paddle-shaft 80 thereby encouraging the cord 83 to wind onto the winding drum 100. However, a user need not overcome any resistance during this pushing step, just as a paddler does not encounter any resistance during an air-push step of the kayaking stroke.

The resistance-creating device 84 further includes a pair of pulley-members which are best explained by referring back to FIGS. 1–3. The pulley-members are mounted on the top horizontal bar 38 of the top support member 34 on opposite sides of the tension mechanism 84. More particularly, the pulley-members 130 are preferably located nine inches from the center of the top horizontal bar 38. Although not specifically shown in the drawings, the pulley-members are mounted in such a manner that they can both pivot and rotate relative to the top horizontal bar 38.

The push/pull cords 82 and 83 are threaded through the pulley-members 130. The placement of the pulley-members 130 allows the kayaking simulator machine 10 to imitate the specific blade-resistance encountered during the water-pull step of a kayaking stroke. Although the working length of the cords 82 and 83 will change during a kayak simulating session, it may be noted that the length of each of the cords 82 and 83 is approximately thirty inches from the respective pulley to the end of the paddle-shaft 80 when the machine 10 is in the position shown in FIGS. 1 and 2.

One may now appreciate that the kayak simulator machine 10 accurately simulates the kayaking motion and thereby develops correct kayaking technique as well as exercising the appropriate muscles. Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A kayak simulator machine comprising a support assembly, a resistance-creating device coupled to said support assembly, a cord member coupled to said resistance-creating device, and a paddle-shaft coupled to said support assembly by said cord member;

said paddle-shaft having opposite ends rotatably attached to said cord member whereby said paddle-shaft may be twisted about its longitudinal axis relative to said cord member;

said cord member being coupled to said resistance-creating device in such a manner that a pulling-resistance is imposed when said paddle-shaft is pulled, said pulling-resistance being greater than the pushing-resistance imposed when said paddle-shaft is pushed;

said cord member also being coupled to said resistance-creating device in such a manner that said pulling-resistance is applied to the ends of said paddle-shaft;

said paddle-shaft being coupled to said support assembly in such a manner that a center portion of said paddle-shaft may pivot in a three-dimensional pivot space;

said support assembly including a support frame, a seat unit, a thigh brace unit and a foot brace unit which are coupled to said support frame in such a manner that a user properly interfacing with these components will be situated in a kayak simulator position; and wherein said cord ends are connected to each of said paddle-shaft ends by a coupling means.

2. A kayak simulator machine as set forth in claim 1 wherein said resistance-creating mechanism includes a tension mechanism which is attached to said support assembly and which imposes said pulling-resistance when an end of said paddle-shaft is pulled.

3. A kayak simulator machine as set forth in claim 2 wherein said resistance-creating device further includes a pair of pulley-members through which said cord member is threaded, said pulley-member applying said pulling-resistance to the other ends of said paddle-shaft.

4. A kayak simulator machine as set forth in claim 3 wherein said paddle-shaft is only coupled to said support assembly by said cord-member.

5. A kayak simulator machine as set forth in claim 4 wherein said support assembly includes a support frame, a seat unit, a thigh brace unit and a foot brace unit which are coupled to said support frame in such a manner that a user properly interfacing with these components will be situated in a kayak simulating position.

6. A kayak simulator machine comprising a support assembly, a resistance-creating device coupled to a said support assembly, a cord member coupled to said resistance-creating device, and a paddle-shaft coupled to said support assembly by said cord member;

said cord member being coupled to said resistance-creating device in such a manner that a pulling-resistance is imposed when said paddle-shaft is pulled, said pulling-resistance being greater than a pushing-resistance imposed when said paddle-shaft is pushed;

said cord member also being coupled to said resistance-creating device in such a manner that said pulling-resistance is applied to the ends of said paddle-shaft;

said resistance-creating mechanism including a first member and a second member movable with respect to said first member in one direction and in another direction different from said one direction, said resistance-creating member further including a friction-absorbing member arranged to impede the movement of said first and second members relative to one another to thereby impart said pulling-resistance on said cord member, said cord member being attached to said resistance-creating member so that pulling of one end of said paddle-shaft will cause movement of said second member in said one direction and further so that pulling of the other end of said paddle shaft will cause movement of said second member in said different direction; and said cord ends are connected to each of said paddle-shaft ends by a coupling means.

* * * * *